US005608932A

United States Patent [19]

Hasegawa

[11] Patent Number: 5,608,932

[45] Date of Patent: Mar. 11, 1997

[54] ARTICULATED BED APPARATUS

[75] Inventor: Takashi Hasegawa, Higashiyamato, Japan

[73] Assignee: France Bed Co., Ltd., Tokyo, Japan

[21] Appl. No.: 417,956

[22] Filed: Apr. 6, 1995

[30] Foreign Application Priority Data

May 2, 1994 [JP] Japan ..... 6-093194

[51] Int. Cl.[6] ..... A47B 9/00; A47C 17/16

[52] U.S. Cl. ..... 5/611; 5/600; 5/613; 5/616; 5/618

[58] Field of Search ..... 5/86.1, 600, 611, 5/613, 616, 617, 618

[56] References Cited

U.S. PATENT DOCUMENTS

| | | | |
|---|---|---|---|
| 4,084,274 | 4/1978 | Willis et al. | 5/613 |
| 4,658,450 | 4/1987 | Thompson | 5/618 |
| 4,984,774 | 1/1991 | Zupancic et al. | 5/600 |
| 5,063,623 | 11/1991 | Bathrick et al. | 5/618 |
| 5,125,122 | 6/1992 | Chen | 5/618 |
| 5,257,428 | 11/1993 | Carroll et al. | 5/618 |
| 5,303,437 | 4/1994 | Hung | 5/613 |

FOREIGN PATENT DOCUMENTS

| | | | |
|---|---|---|---|
| 2293897 | 7/1976 | France | 5/400 |
| 563139 | 6/1975 | Italy | 5/400 |

*Primary Examiner*—Steven N. Meyers
*Assistant Examiner*—Robert G. Santos
*Attorney, Agent, or Firm*—Frishauf, Holtz, Goodman, Langer & Chick

[57] ABSTRACT

A bed apparatus is provided which has a support frame, a rotation frame and a bed plate structure. The rotation frame has a one-end side and other-end side supported in a width direction so that one of these end sides each serving as a fulcrum is rotatable in a direction in which an opposite-end side of the rotation frame is raised. A link mechanism is connected to the rotation frame and driven by a drive source. The bed plate structure comprises a middle bed plate assembly and a pair of side bed plate assemblies connected to the middle bed plate assembly such that these side bed plate assemblies can be rotated in the raised direction only. With the rotation frame rotated, one of these side bed plate assemblies which is situated on a lower side in the rotation direction is abutted against the support frame to allow the bed plate structure to be bent upwardly.

19 Claims, 9 Drawing Sheets

ARTICULATED BED APPARATUS

BACKGROUND OF THE INVENTION

1. Field of the Invention

The present invention relates to a bed apparatus effective to prevent development of any bedsore in a prolonged bed user especially, such as a bed-ridden ill or elderly person.

2. Description of the Related Art

The patient, being unable to turn in a bed or raise his or her own body, has to be kept confined to the bed for a prolonged period of time. The bed user, continuing his or her supine position over a prolonged period of time, has often suffered from a bedsore, causing greater pain in the user. In order to prevent such a problem, the patient has to change his or her assumed body position in a proper way. A bed apparatus has been developed to solve such a problem.

Conventionally, this kind of bed apparatus has, for example, the following problems. That is, the bed apparatus includes a bed body having a rotation frame supported such that it can be rotated, in a right/left direction, with the width-direction midpoint used as a rotation axis. The rotation frame includes a bed plate structure. The bed plate structure has a middle bed plate assembly and a pair of side bed plate assemblies provided one at each side of the middle bed plate assembly in which case these bed plate assemblies are rotatable in an upward direction.

When the rotation frame is rotated, in the right/left direction, with the width-direction midpoint used as the rotation axis, the side bed plate assembly on the lowering width-direction one-end side of the rotation frame abuts against a stopper, thereby preventing rotation in a downward direction so that upward bending is obtained on the side bed plate assembly. The patient lying in the middle bed plate assembly has his or her body position changed in accordance with the rotation of the middle bed plate assembly and is prevented, by the upwardly bent side bed plate assembly, from falling from the bed plate structure down onto the bedside floor. Thus, the patient in the bed has his or her body position changed through an alternate right/left-direction rotation of the rotation frame so that a bedsore can be prevented.

When the body position of the patient has to be changed in the bed apparatus thus arranged, the rotation frame is rotated, in the right/left direction, with the width-direction midpoint used as a fulcrum and, by doing so, the middle bed plate assembly of the bed plate structure is interlockingly moved with the rotation of the rotation frame.

For this reason, the rotation frame is so rotated that, with the width-direction midpoint used as a fulcrum, either one side is raised and the other side is lowered in which case the middle bed plate assembly is interlocked with the rotation of the rotation frame.

If the rotation frame is rotated with the width-direction midpoint as a fulcrum, adequate space has to be secured on the lower surface side of the rotation frame so that the one-end side of the rotation frame in the width direction may be rotated in the downward direction. To this end, it is necessary to increase the height of the bed body, that is, the support height of the middle bed plate relative to the bed body.

With the support height of the middle bed plate assembly so increased, it becomes difficult for the bed user to get into and out of the bed body and, for an ill person in particular, it has sometimes been almost impossible to climb into and out of the bed body. This is very inconvenient to the bed user. Therefore, the support height of the bed body should be made as low as practical so that the patient can readily get into and out of the bed body.

In the cases where any patient in a bed in the supine position is examined for any diseased conditions or any action is needed for bedside care, if the patient bed is supported at too low a level, then it is difficult for a doctor or an attendant to see or care for the patient properly. In this case it is desirable that the support height of the patient be adjustably varied.

As appreciated from the above, the conventional bed apparatus is so configured that, when the patient has his or her body position changed properly, the middle bed plate assembly in a bed plate structure is so rotated as to be raised at its width-direction one-end side and lowered at its width-direction other-end side. Sufficient space needs to be secured on the lower surface side of the middle bed plate assembly so as to enable the middle bed plate assembly to be lowered on its width-direction other-end side. For this reason, the bed plate structure has to be supported at a high level and, moreover, a patient often cannot climb into and out of the bed body on his or her own. Accordingly, such a bed structure is often not easy to utilize for a prolonged bed user.

SUMMARY OF THE INVENTION

One object of the present invention is to provide a bed apparatus which can support a bed structure at a low enough height level so that the patient can readily get into and out of the bed structure, and which can rotate an associated rotation frame in the right/left direction to enable the bed user to change his or her body position.

Another object of the present invention is to provide a bed apparatus which can change a bed user's body position and, at this time, change the height level at which the bed user is supported on the bed structure.

Another object of the present invention is to provide a bed structure which, in spite of being capable of freely rotating a bed structure in a width direction, can give no vibration to the bed structure in a horizontally supported position.

According to a first preferred embodiment of the present invention, there is provided a bed apparatus comprising:

a support frame;

a rotation frame having a one-end side and other-end side supported on the support frame in a width direction so that one of these end sides each serving as a fulcrum is rotatable in a direction in which an opposite-end side of the rotation frame is raised;

rotation drive means having a link mechanism connected to the rotation frame and a drive source provided on the support frame and adapted to drive the link mechanism, the rotation drive means rotating the rotation frame by driving the link mechanism by the drive source; and a bed plate structure having a middle bed plate assembly and a pair of side bed plate assemblies provided one at each side of the middle bed plate assembly and connected to be rotated only in an upward direction, the bed plate structure being placed on the rotation frame and being such that, when the rotation frame is rotated, one of these side plate assemblies which is situated on a lower side in the rotation direction is abutted against the support frame to allow the bed plate structure to be bent upwardly.

According to a second embodiment of the present invention, there is provided a bed apparatus comprising:

a base;

a rest frame placed on the base;

a raising/lowering drive mechanism provided at the base and adapted to raise and lower the rest frame;

a support frame provided on the rest frame;

a rotation frame having one-end side and other-end side supported on the support frame in a width direction so that one of these end sides each serving as a fulcrum is rotatable in a direction in which an opposite-end side of the rotation frame is raised;

rotation drive means having a link mechanism connected to the rotation frame and a drive source provided on the support frame and adapted to drive the link mechanism, the rotation drive means rotating the rotation frame by driving the link mechanism by the drive source; and a bed plate structure having a middle bed plate assembly and a pair of side bed plate assemblies provided one at each side of the middle bed plate assembly and connected to be rotated only in an upward direction, the bed plate structure being placed on the rotation frame and being such that, when the rotation frame is rotated, one of these side plate assemblies which is situated on a lower side in the rotation direction is abutted against the support frame to allow the bed plate structure to be bent upwardly.

In the bed apparatus according to the first embodiment, the bed plate assembly can be rotated in a right/left direction without increasing the support height of the bed plate structure.

In the bed apparatus according to the second embodiment, the support height of the bed plate structure can be varied as required.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

A bed apparatus according to an embodiment of the present invention will be explained below with reference to the accompanying drawings.

Figure 1:
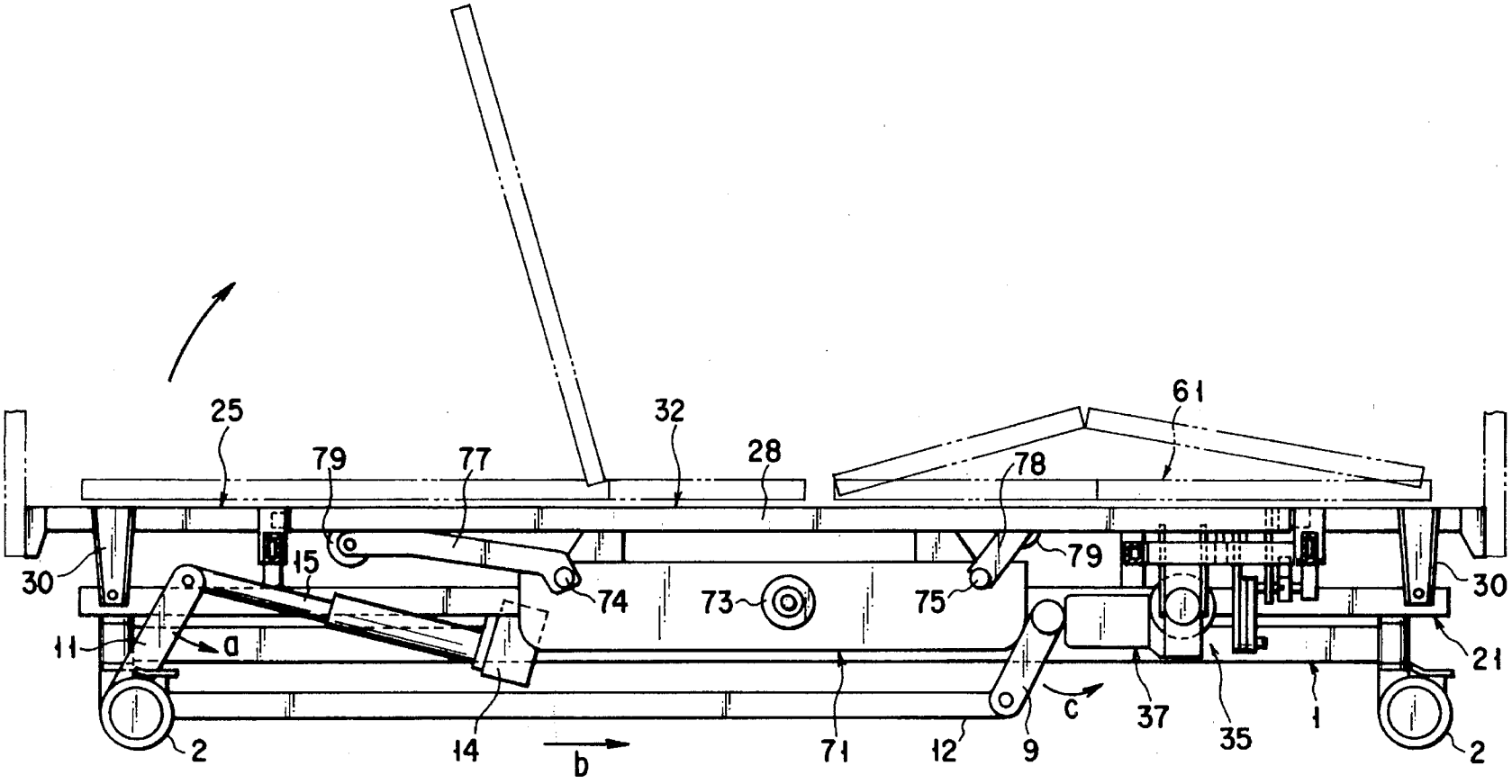
FIG. 1 is a front view generally showing a bed apparatus according to an embodiment of the present invention.
Figure 3:
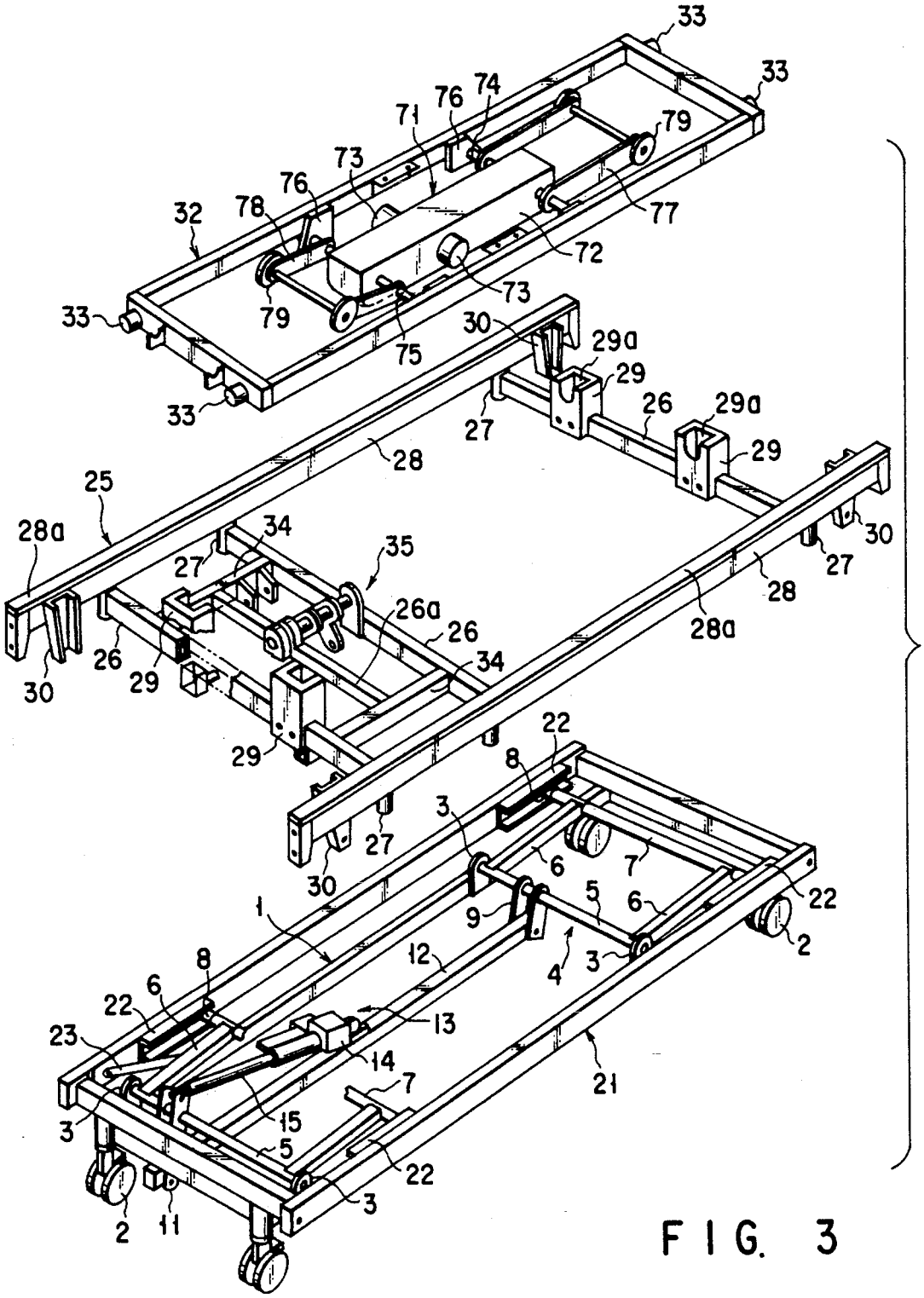
FIG. 3 is a perspective, exploded view showing a base, support frame and rotation frame in the embodiment.

A bed apparatus as shown in FIG. 1 includes a base 1 of a rectangular frame. The base 1 has stopper-equipped casters 2 at four corners on its lower surface. A pair of brackets 3 are provided uprightly in those opposed side positions of the base 1 at each end of a longitudinal direction such that one pair of brackets 3 is located in a corresponding relation to the other pair of brackets 3 as viewed in a width direction as shown in FIG. 3. A pair of rotation shafts 5 constituting a raising/lowering link mechanism 4 are rotatably spanned on each pair of brackets 3. A pair of levers 6 are fixed at one end to the end portions of the respective rotation shafts 5. A support shaft 7 is fixed at an end portion to the other end sides of the levers 6 in a respective pair. A roller 8 is rotatably provided on each extreme end of the respective support shaft 7.

A first arm 9 is fixed at a one-end side to an intermediate portion of one rotation shaft 5 and a second arm 11 is fixed at its intermediate portion to the intermediate portion of the other rotation shaft 5. One and the other end of an interlocking rod 12 are pivotally mounted on the other end of the first arm 9 and one downwardly extending end of the second arm 11, respectively. A raising/lowering drive mechanism 13 is provided on the upper surface of an intermediate portion of an interlocking rod 12. The raising/lowering drive mechanism 13 comprises a drive source 14 swingably mounted on the interlocking rod 12 and a drive shaft 15 driven by the drive source 14 in back and forth motion and the forward end of the drive shaft 15 is pivotally mounted on the other end of the second arm 11.

When the drive shaft 15 is driven in a projecting direction with the operation of the raising/lowering drive mechanism 13, the second arm 11 is rotated in a counterclockwise direction as indicated by arrow "a" in FIG. 1 in interlock with the one rotation shaft 5. With the rotation of the second arm 11, the interlocking rod 12 is slidably moved in a direction as indicated by an arrow b in FIG. 1 to allow the first arm 9 to be rotated in a counterclockwise direction as indicated by an arrow c in FIG. 1.

with the first and second arms 9 and 11 so rotated in the counterclockwise direction, the respective pair of levers 6 connected to the respective arms are rotated from a lying-down position to a raising position as shown in FIG. 3.

Figure 11:
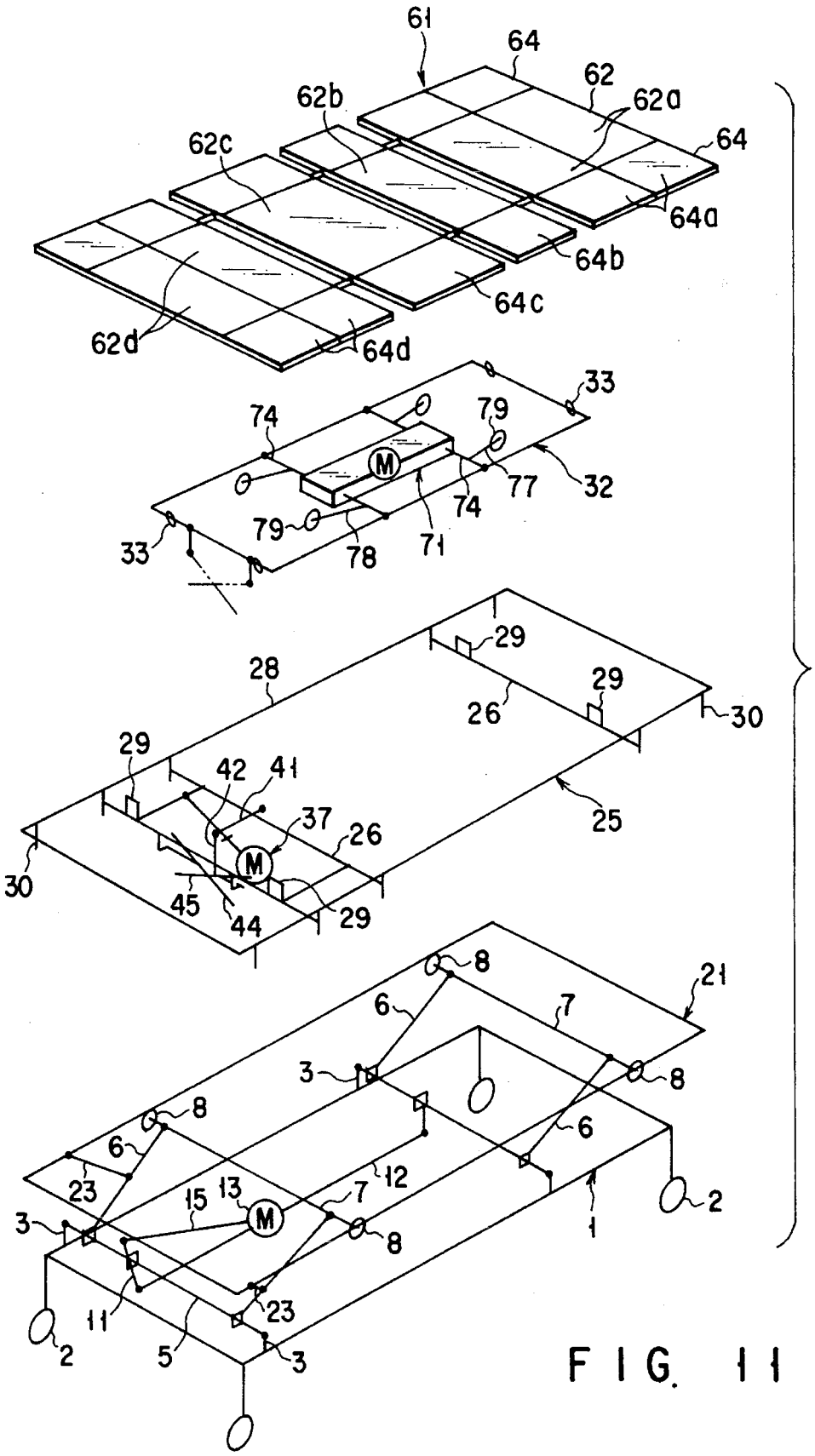
FIG. 11 is an exploded, perspective view generally showing an arrangement of the bed apparatus.

Rollers 8 at both the ends of the support shafts 7 connected to the respective levers 6 are placed in rollable contact with corresponding u-cross-sectional guide rails 22 provided at the inner surface of opposed sides of a rectangular rest frame 21. With the paired levers 6 rotated in a raising direction, the rest frame 21 is raised through the rollers 8. FIG. 11 shows a state in which the rest frame 21 is raised over the base 1.

In order to prevent the raised rest frame 21 from being freely moved along a longitudinal direction through the contact of the rollers with the guide rails, one end and other end of a connection link 23 are rotatably connected to the rest frame 21 and lever 6 as shown in FIG. 3. The connection link 23 inhibits the rest frame 21 with the rollers 8 supported in the guide rails 22 from being freely moved in a horizontal direction. The detaching of the connection link 23 enables the rest frame 21 to be detached from the base 1.

Figure 4:
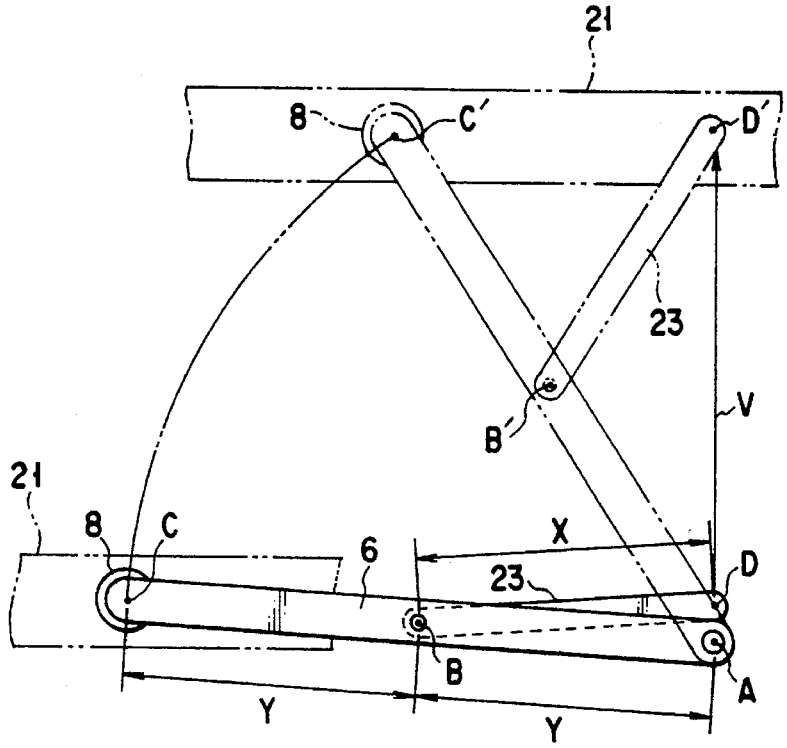
FIG. 4 is an explanatory view for explaining the manner in which a rest frame is raised.

With A, B and C representing a rotation support point, a longitudinal midpoint and the other end of the lever (the roller-mount side end) 6, respectively, and D representing the other end of the connection link 23 as shown in FIG. 4, the lengths AB, BD, BD and BC are set to AB=BD and BD=BC. In consequence, a triangle defined by the three points A, B and D and that defined by the three points B, C and D are isosceles triangles.

If the points A, B, C and D are shifted to points A', B', C' and D' as indicated by a phantom line in FIG. 4 as in the case where the rest frame 21 is moved to a raised position, then a triangle defined by the three points A, B' and D' and that defined by the three points B', C' and D' become isosceles triangles.

when the lever 6 is rotated from the lying-down position toward the raised direction, the respective configurations maintain their isosceles triangles and the other end D side of the connection link 23 is raised to the point D' in a vertical direction as indicated by an arrow V in FIG. 4. Further, the points C and D, while maintaining substantially the same height in a horizontal direction, are upwardly shifted to the points C' and D'.

As a result, the rest frame 21 can be raised and lowered in the horizontal state without involving a horizontal slide motion and hence is neither tilted nor has its longitudinal end abutted against a wall surface.

Figure 2:
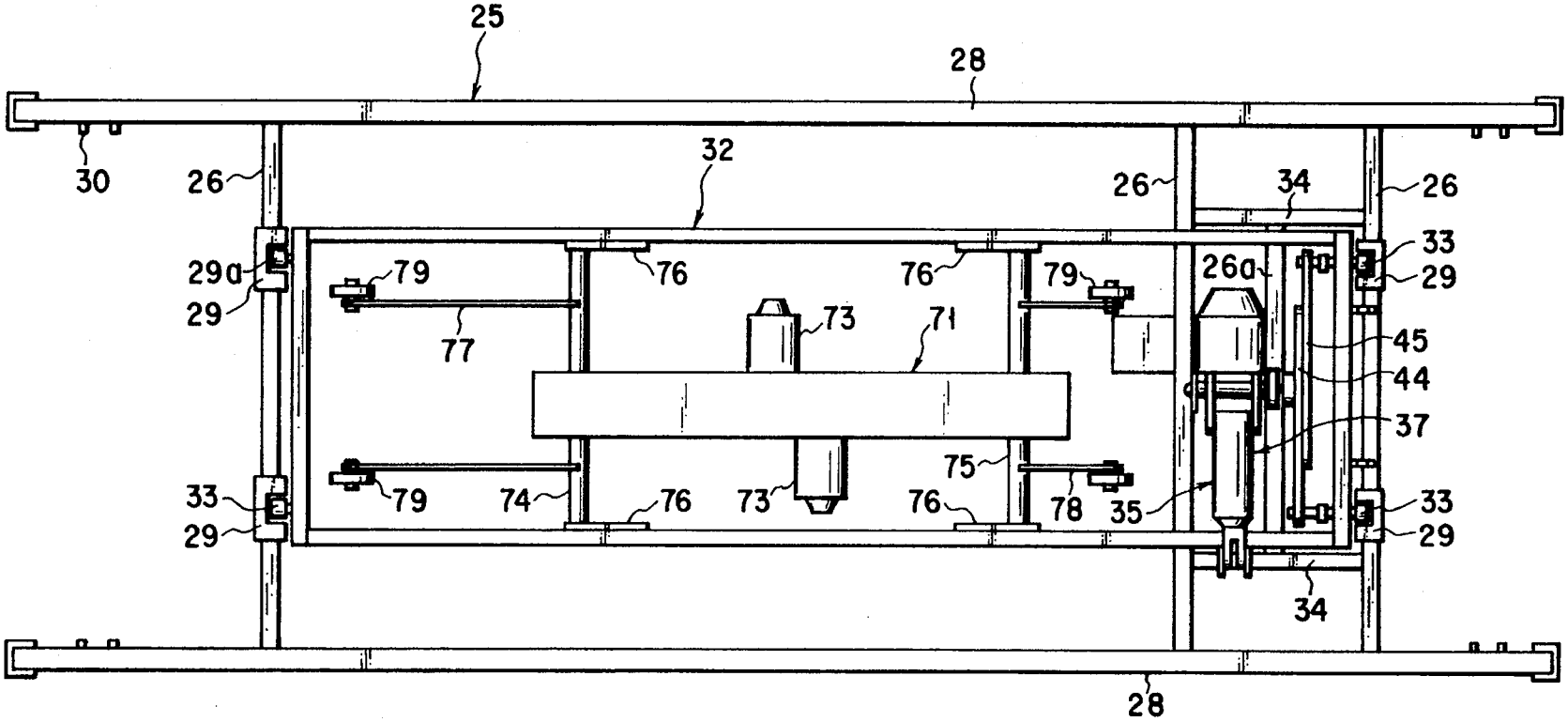
FIG. 2 is a plan view, partly omitted, showing a support frame in FIG. 1.

A rectangular support frame 25 larger than the rest frame 21 is detachably fixed to the upper surface of the rest frame 21. The support frame 25 has three lateral rods 26 provided along the width direction and longitudinal rods 28 mounted by connection members 27 on both the ends of the respective lateral rods as shown in FIGS. 2 and 3. An abutting plate **28*a* made of a resin is provided on the upper surface of the longitudinal area of the respective longitudinal rod 28**.

A pair of receiving members 29 are uprightly provided on the opposed end portions of the pair of lateral rods 26 which in turn are each provided on both the longitudinal end portions of the support frame 25. The receiving members 29 have arcuate recesses **29*a*, one of the pair of receiving members 29 having arcuate recesses 29*a* opened at the top side and the other of the pair of receiving members 29 having arcuate recesses 29*a* opened at the inside surface side, as shown in FIGS. 2 and 3**.

A rotation frame 32 is provided relative to and between the pair of longitudinal rods 28 of the support frame 25. A pair of support rollers 33 are rotatably mounted one at each end face of the respective longitudinal section of the rotation frame 32. The respective support roller 33 is engaged with the associated recess **29*a* in the receiving member 29**.

A connection bracket 30 is provided on end portions of each of the pair of longitudinal rods 28 of the support frame 25 such that the connection bracket 30 depends from its fixed upper end portion. The lower end portion of the respective connection bracket 30 is detachably mounted at each of four corners of the rest frame 21 as shown in FIG. 1. The support frame 25 is interlockingly moved with the up/down motion of the rest frame 21.

Figure 6:
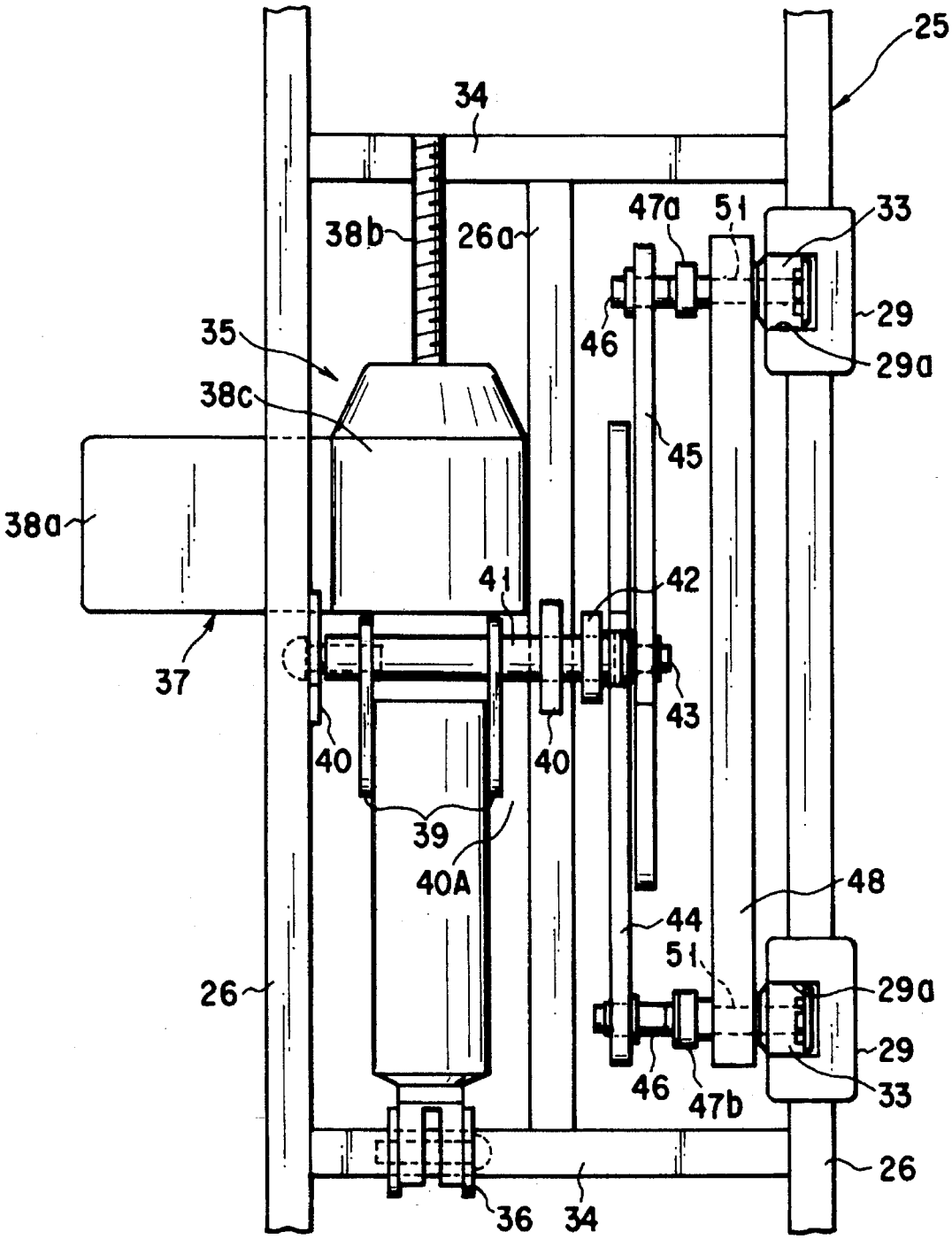
FIG. 6 is a plan view showing the rotation drive means.

A pair of mounting rods 34 are spanned between the pair of lateral rods 26, one lateral rod 26 being provided at one longitudinal end portion and the other lateral rod 26 being provided at the intermediate portion of the support frame 25 as shown in FIGS. 2, 3 and 6. An auxiliary lateral rod **26*a* is spanned between the intermediate portions of the mounting rods 34 in a parallel relation to the lateral rod 26. A rotation drive means 35 is provided relative to these rod members 26, 26*a* and 34 to allow the rotation frame 32** to be rotated in a right/left direction.

The rotation drive means 35 is so constructed as shown in FIGS. 5 to 8. A bracket 36 is provided at the lower surface side of the one-side mounting rod 34 as shown in FIG. 6 and a drive source 37 has its one end pivotally mounted on a bracket 36. The drive source 37 comprises a motor **38*a*, a screw shaft 38*b* rotated through the rotation of the motor 38*a*, and a movable body 38*c* movable along the screw shaft 38*b***.

Figure 5:
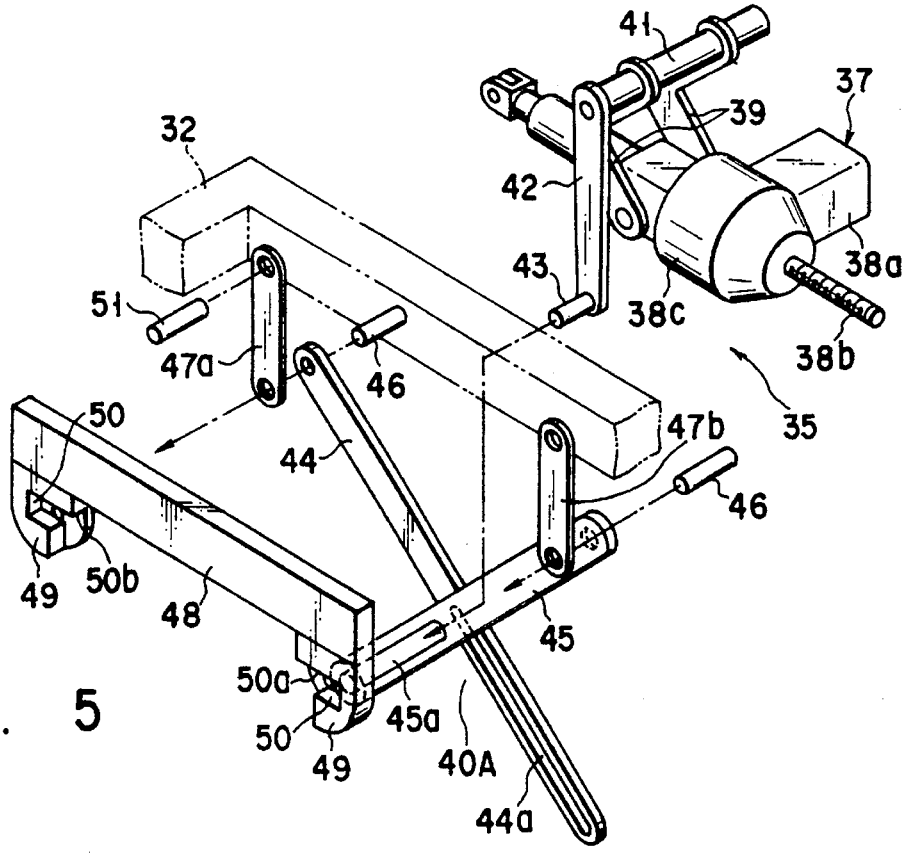
FIG. 5 is a perspective, exploded view showing a section of a link mechanism in a rotation drive means.

A pair of first links 39 of an L shape are pivotably mounted at one end to the movable body **38*c* to provide a link mechanism 40A as shown in FIG. 5. The first link 39 is fixed at the other end to a support shaft 41. The support shaft 41 is rotatably spanned on brackets 40 which are mounted upright on the one-side lateral rod 26 and auxiliary lateral rod 26*a* as shown in FIGS. 5 and 6**.

One end portion of the support shaft 41 is projected from the one-side bracket 40 toward the other-side lateral rod 26 side. One end of a second link 42, which is straight, is fixed to the projecting end of the support shaft 41. An interlocking pin 43 is provided on the other end of the second link 42 and projected there. The interlocking pin 43 is slidably engaged with elongated holes **44*a* and 45*a* extending from one end side to an intermediate area side of the third and fourth links 44 and 45**, respectively, and cannot be slipped out of these elongated holes.

One end side of the connection pin 46 is pivotally mounted on the other end side of the third and fourth links 44 and 45 as shown in FIG. 5. One-end sides of connection links **47*a*, 47*b* and one side faces of retaining members 49, 49 are pivotally mounted on the connection pins 46, 46 with the retaining members 49, 49 fixed to both end portions of a steady link 48. The other-end sides of the connection links 47*a*, 47*b* are pivotally mounted on both end portions of the rotation frame 32 in a width direction on one longitudinal end of the rotation frame 32**.

Figure 7:
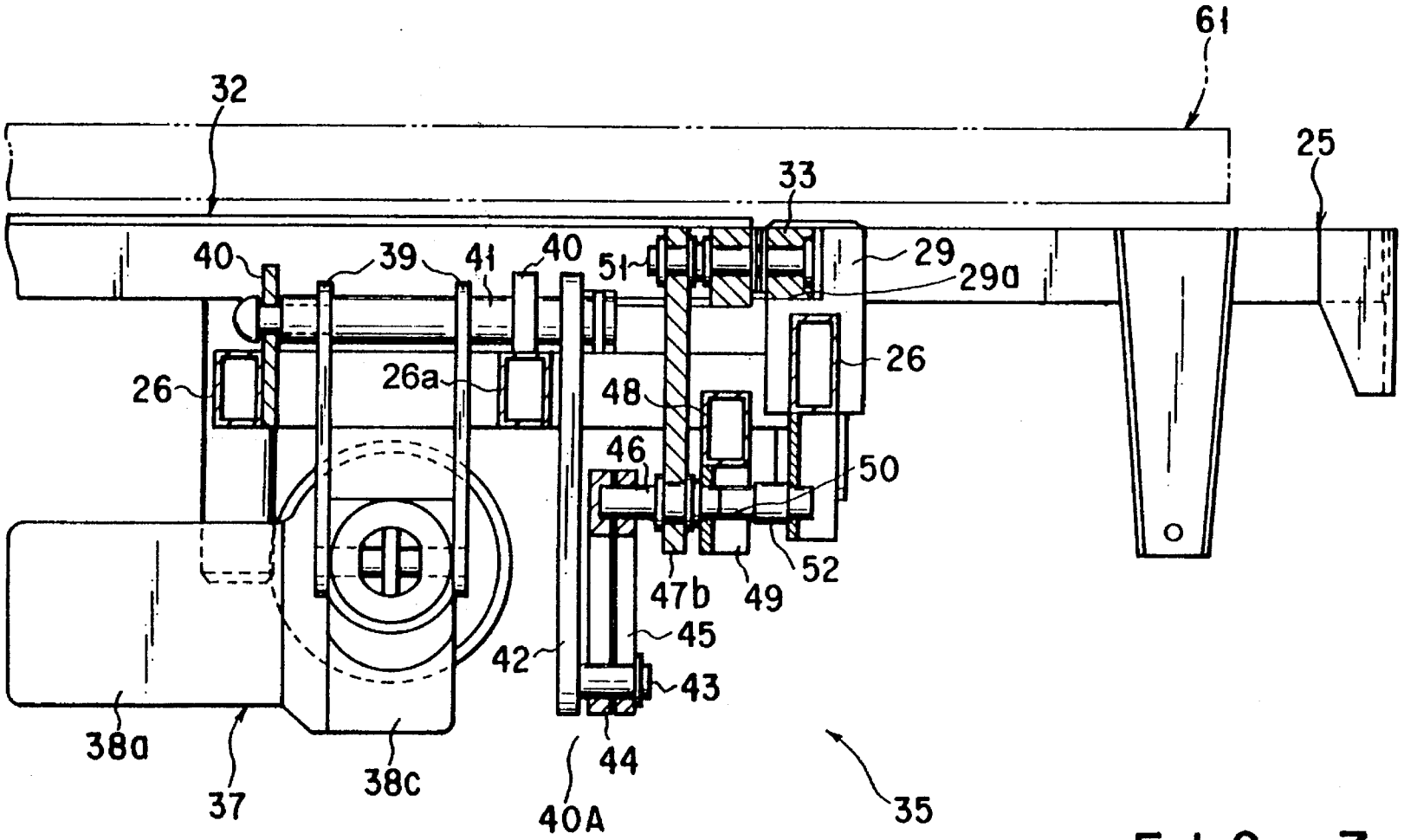
FIG. 7 is a side view showing the rotation drive means in the embodiment.

The other-end sides of the connection links **47*a*, 47*b* and support rollers 33, 33 on both the ends of the rotation frame 32 are mounted on the rotation frame 32 by means of an associated pin 51 as shown in FIGS. 6 and 7 (see 47*b***).

Figure 9:
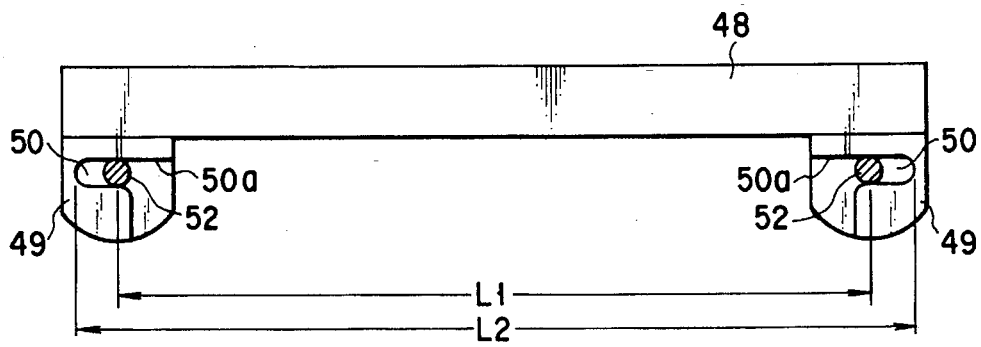
FIG. 9 is an enlarged plan view showing a steady link in the embodiment.

Substantially L-shaped steady grooves 50 are provided, as engaging means, on the other side faces of the retaining members 49 and opened at one-end face side and lower end face side situated inside in the width direction of the support frame 25. An engaging pin 52 serving as a engaging body is projected from the other-side lateral rod 26 toward the auxiliary lateral rod **26*a* and slidably engaged with the steady groove 50 of the retaining member 49 as shown in FIGS. 7 and 9. As shown in FIG. 9, a distance L1 between the engaging pins 52 is made somewhat greater than a distance between those open ends of the pair of steady grooves 50 but made smaller than a distance L2 between the extreme ends of the steady grooves 50**.

With the rotation frame 32 in a horizontal state, the paired engaging pins 52 are engaged with the associated steady grooves 50 of the retaining members 49 so that the rotation frame 32 is held in a steady state without being shaken in a right/left direction. That is, since the rotation frame 32 is rotatably supported by a link mechanism 40, it is unavoidable that, when the link mechanism 40A is not in a driven state, that is, the rotation frame 32 is in the horizontal state, shaking occurs in the rotation direction due to a play at the respective link.

when, however, the rotation frame 32 is in the horizontal state, the paired engaging pins 52 are engaged with the associated steady grooves 50 of the retaining members 49 and the rotation frame 32 is prevented from being shaken in the right/left direction.

Figure 8:
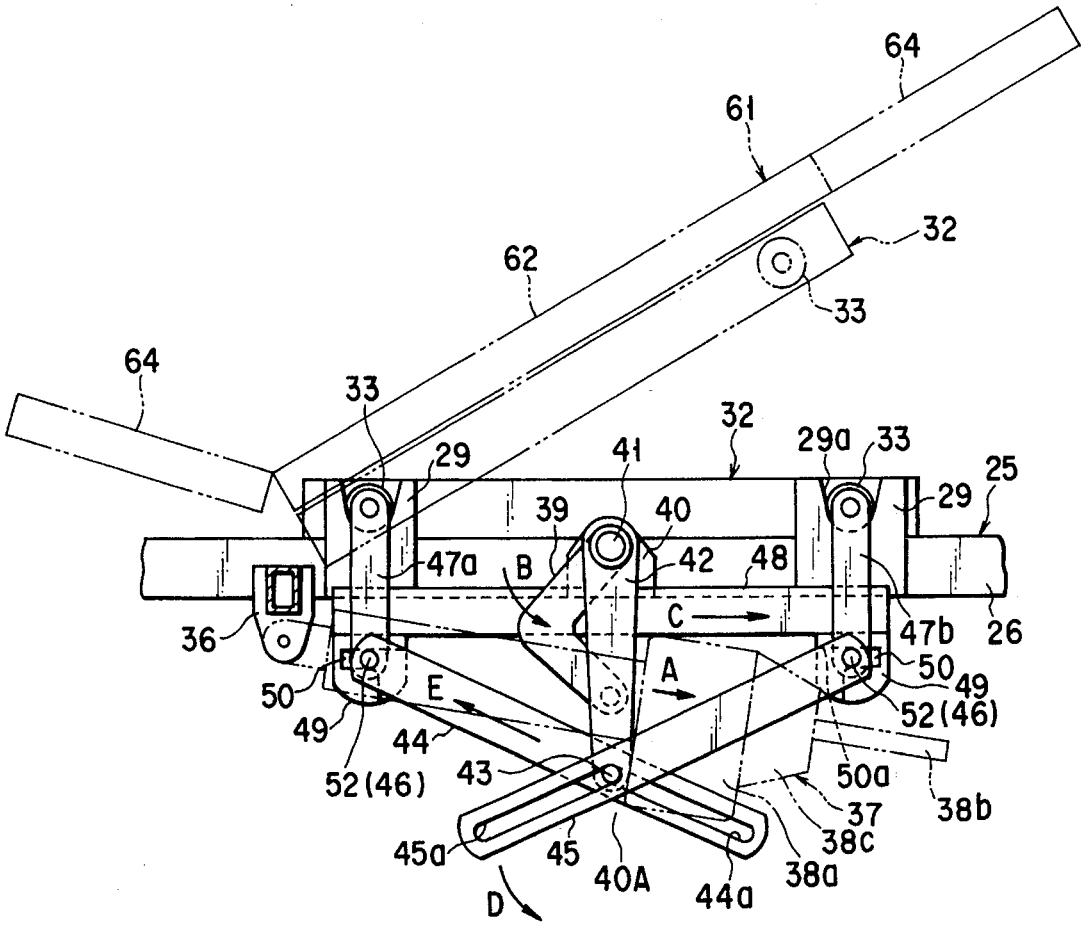
FIG. 8 is a plan view showing the rotation drive means in the embodiment.

When, as shown in FIG. 8, the movable body 38*c* of the drive source 37 is driven in a direction of an arrow A, the first link 39 is rotated in a direction of an arrow B and, in this case, it is done in interlock with the second link 42, the interlocking pin 43 provided at the other-end side of the second link 42 is engaged with the upper end of the elongated hole 45*a* of the fourth link 45 to allow the link 45 to be rotated in a raised direction of an arrow D in FIG. 8 and, at the same time, the interlocking pin 43 is slidably moved along the elongated hole 44*a* in the third link 44*a*.

When the fourth link 45 starts its rotation, the steady link 48 is also moved in slide motion in the horizontal direction as indicated by an arrow C. As a result, the steady groove 50 of the one side retaining member 49 situated on the upper end side of the fourth link 45 is allowed to be disengaged from the one side engaging pin 52 and the other side engaging pin 52 is relatively moved in slide motion toward the extreme end side of the steady groove 50 of the other side retaining member 49.

When this occurs, the steady link 48 is brought to a state of rotation with the other side engaging pin 52 as a fulcrum so that the steady link 48 is interlocking in with the fourth link 45.

With the rotation of the steady link 48, the rotation frame 32 is interlockingly moved through the connection links 47*a*, 47*b* as indicated by a phantom line in FIG. 8, that is, the rotation frame 32 has its other-end side raised over the support frame 25 with the support rollers 33, that is, rollers 33 supported in the associated recesses 29*a* of the receiving members 29 on the one-end side of the rotation frame 32 in a width direction, as their fulcrums.

When, with the rotation frame 32 in a tilted state, the first links 39 are rotated in a direction reverse to the arrow B to drive the movable body 38*c* of the drive source 37 in a direction reverse to the arrow A, the rotation frame 32 and steady link 48 are rotated toward a lying-down direction. With the steady link 48 is lowered to a substantially horizontal state to allow the one side engaging pin 52 to abut against the opened lower face 50*a* (FIG. 9) of the steady groove 50 of the retaining member 49. With further driving of the first links 39 from that state, the interlocking pin 43 is upwardly moved in slide motion into abutting contact with the extreme end of the elongated hole 44*a* in the third link 44 to push the third link 44 in a direction of an arrow E in FIG. 8. As a result, the steady link 48 slides in a horizontal direction reverse to the arrow C to allow the one side engaging pin 52 to be brought back into engagement with the steady groove 50 of the one side retaining member 49. That is, the rotation frame 32 is held in a horizontal state without being shaken in the right/left direction.

If, from this state, the movable body 38*c* of the drive source 37 is driven in an opposite direction, that is, in a direction reverse to the arrow A, the third link 44 is upwardly moved in a raised direction and the rotation frame 32 can be rotated with its width-direction other-end side as a fulcrum.

Figure 10A:
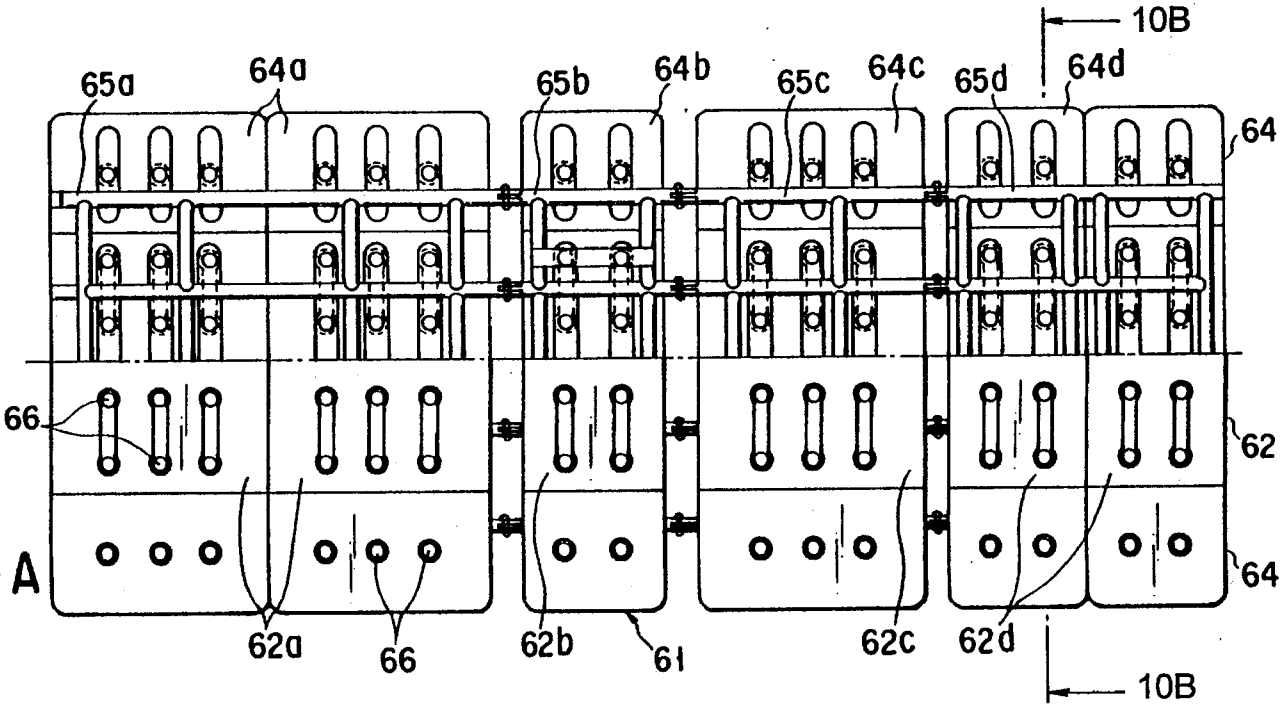
FIG. 10A is a plan view showing a bed plate structure as viewed from below.

A bed plate structure 61 is disposed on the upper side of the support frame 25 and rotation frame 32. The bed plate structure 61 comprises, as shown in FIGS. 10A and 10B, a middle bed plate assembly 62 having a size substantially corresponding to that of the rotation frame 32 and a pair of side bed plate assemblies 64 connected, by hinges 63 as will be set out below, to both sides of the middle bed plate assembly such that these side bed plate assemblies 64 can be rotated only in the raised direction.

The respective bed plate assemblies 62 and 64 are provided in plural numbers, that is, as first to fourth bed plates 62*a* to 62*d* and 64*a* to 64*d*, respectively, in the present embodiment. The bed plates of the respective bed plate assemblies 62 and 64 are placed over four mounting frames 65*a* to 65*d* sequentially connected in a rotatable manner. The respective bed plates 62*a* to 62*d* of the middle bed plate assembly 62 are fixed to the mounting frames 65*a* to 65*d*. The floor plates 62*a* to 62*d* of the side bed plate assembly 62 are placed over the mounting frames 65*a* to 65*d* to allow them to be rotated upwardly.

Of the respective bed plates, only the bed plate 62*b* of the middle floor plate assembly 62 is detachably fixed to the rotation frame 32 and the other bed plates are simply placed over the rotation frame 32.

Figure 10B:
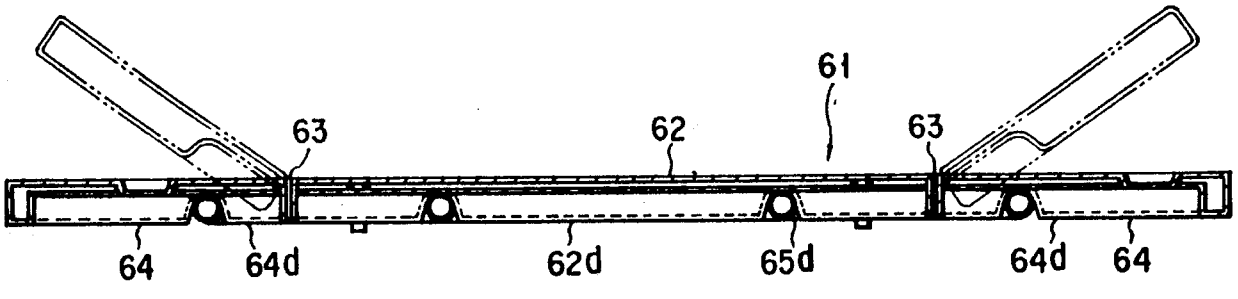
FIG. 10B is an enlarged, cross-sectional view, taken along line 10B—10B in FIG. 10A.

As shown in FIG. 10B, the respective bed plates 62*a* to 62*d* and 64*a* to 64*d* are provided as an integral structure by blow-molding the middle bed plate assembly 62 and paired side bed plate assemblies 64 with a synthetic resin. The middle bed plate assembly 62 and paired side bed plate assemblies 64 are formed as a hollow structure having a predetermined thickness. The top ends of the middle bed plates and those of the side bed plates as viewed in their thickness direction are connected, as an integral structure, by thinned areas serving as hinges 63.

The side bed plate assemblies 64 can be rotated relative to the middle bed plate assembly 62 in a raised direction as indicated by a phantom line in FIG. 10B and the rotation of the side bed plates in a down direction is restricted by the abutting contact of the side bed plate ends with the adjacent ends of the middle bed plates.

A plurality of air ports 66 are provided at the respective bed plates of the middle and side bed plate assemblies at the time of blow molding to penetrate through their thickness. By doing so, the bed plate structure 61 allows air to pass through the air ports in the thickness direction.

The bed plates 62*a* to 62*d* and 64*a* to 64*d* are formed of two kinds of molding units differing in their size. A pair of juxtaposed molding units are placed at each longitudinal end of the bed plate structure and two molding units of different size are placed between one pair of juxtaposed molding units at one end and the other pair of juxtaposed molding units on the other end of the bed plate structure.

When the rotation frame 32 is rotate by the rotation drive means 35 and, at this time, it is done in interlock with the middle bed plate assembly 62 in the bed plate structure 61, the one side bed plate 64 situated on the "raised" side is maintained on the same plane as the middle bed plate assembly 62 while the other side bed plate assembly 64 situated on the lower end side is abutted against the abutting plate 28*a* (shown in FIG. 3) provided on the side area of the support frame 25 so that upward bending is made at a predetermined angle while preventing downward rotation.

By doing so, a user lying on the bed plate structure 61 has his or her body position moved or raised in a right/left direction by the rotation of the middle bed plate assembly 62 in the right/left direction at which time the user is prevented from dropping out of the bed plate structure 61 by the bending of the side bed plate assembly toward the upper side of the middle bed plate assembly 62.

For the support of frame 25, rollers, not shown, may be employed in place of the abutting plates 28*a* in which case bending is achieved by the abutting of the side bed plate assembly 64 against the rollers.

A raising/lowering motion drive mechanism 71 is provided at the intermediate portion of the length of the rotation frame 32 to raise and lower the bed plates 62*a*, and 64*a* of the bed plate assemblies 62 and 64 in the bed plate structure 61 as shown in FIG. 3. The drive mechanism 71 comprises a box 72 incorporating a built-in power transmission mechanism, not shown, a pair of drive sources 73 provided one at each of side surfaces of the box 72, a first rotation shaft 74 provided on one end portion of the box 72 in a manner to extend through the opposed side portions of the box and adapted to be rotated by one of the paired drive sources 73, and a second rotation shaft 75 provided on the other end portion of the box 72 to extend through the opposed side portion of the box 72. Both the ends of each of the first and second rotation shafts 74 and 75 are rotatably supported by associated brackets 76.

First push-up arms 77 are fixed at one end to both the end portions of the first rotation shaft 74 and second push-up arms 78 are fixed at one end to both the end portions of the second rotation shaft 75. The other end portions of each of the push-up arms 77 and 78 are rotatably mounted on associated rollers 79.

The rollers 79 on the first push-up arms 77 are placed in rolling contact with the mounting frame 65*a* mounted on the bed plate 62*a* of the middle bed plate assembly 62 as shown in FIG. 10A and the rollers 79 on the second push-up arms 78 are placed in rolling contact with the mounting frame 65*c* of the third bed plate 62*c* of the middle bed plate assembly 62.

When, with the roller 79 placed in rolling contact with the mounting frames 65*a* and 65*c*, the first rotation shaft 74 is rotated to allow the first push-up arms 77 to be rotated in the raised direction, the first bed plate 62*a* of the middle bed plate assembly 62 is moved up in the "raised" direction and, in this case, it is done in interlock with the first bed plate 64*a* of the side bed plate assembly 64.

When the second rotation shaft 75 is rotated to allow the second push-up arms 78 to be rotated in a "raised" direction, the third bed plate 62*c* of the middle bed plate assembly 62 is rotated in a "raised" direction and it is done in interlock with the fourth bed plate 62*d* and bending is achieved in an upwardly convex dogleg-like manner. With the rotations of the third and fourth bed plates 62*c* and 62*d* of the middle bed plate assembly 62, the corresponding bed plates 64*c* and 64*d* of the side bed plate assemblies 64 are also moved in interlocking manner.

The operation of the bed apparatus thus arranged will be explained below.

The bed plate structure 61 provided over the support frame 25 allows three operations: an up/down motion, a rolling motion in the width direction and a partial raising/lowering bed motion.

For the up/down motion, the raising/lowering drive mechanism 13 is operated, driving the drive shaft 15 in a projected direction. As a result, the levers 6 are raised from the lying-down state through the pair of rotation shafts 5 connected at both the end portions to the levers 6 so that the rest frame 21 can be raised with the rotation of the levers 6.

Since the rotation frame 32 with the bed plate structure 61 placed thereon is provided over the upper side of the rest frame 21 with the support frame 25 interposed, these are raised as one unit. In the case where any action has to be given to a patient on the bed plate structure 61 for bedside care or medical examination, the height level of the bed plate structure can readily be adjusted. Further, when the patient has to climb into or out of the bed plate structure 61, the bed plate structure 61 can be made adequately low so that he or she can readily be get into or out of the bed plate structure.

In order to rotate the bed plate structure 61, the drive source 37 of the rotation drive means 35 is operated to drive the link mechanism 40A. The link mechanism 40A enables the third link 44 or fourth link 45 to be driven in the raised direction in accordance with the direction in which the movable body 38*c* of the drive source 37 is operated.

with the fourth link 45 driven in the raised direction, the rotation frame 32 has its width-direction other-end side raised with the roller 33, that is, the roller engaged with the recess 29*a* of the receiving member 29 on the width-direction one-end side, as a fulcrum.

When the rotation frame 32 has its other-end side raised with the width-direction one-end side as a fulcrum, the bed plate structure 61 is operated in an interlocking manner. That is, the bed plate structure 61 has its middle bed plate assembly's other-end side raised with the width-direction one-end side as a fulcrum as indicated by a phantom line in FIG. 8. As a result, the one side bed plate assembly 64 connected to the width-direction one-end side of the bed plate structure has its lower surface abutted against the abutting plate 28*a* (shown in FIG. 3) of the support frame 25 so that the one side bed plate assembly is bent upwardly. On the other hand, the side bed plate assembly 64 connected to the other-end side of the bed plate structure is interlockingly moved in the same plane as that of the middle bed plate assembly 62.

If the drive source 37 is so operated as to drive the third link 44 in the raised direction, the rotation frame 32 can be rotated in a direction reverse to that set out above.

If, therefore, the direction in which the movable body 38*c* is driven by the drive source 37 is varied, for example, for each predetermined time, then the middle bed plate assembly 62 of the bed plate structure 61 can be rotated by the rotation frame 32 in an alternate right/left motion.

In the case where the middle bed plate assembly 62 is rotated, for each predetermined time, in an alternate right/left motion, any user lying on the bed plate structure 61 can experience his or her body position change in the right/left direction. Any user needing a long-term confinement in bed, such as an ill or an elderly person, can prevent an onset of a bedsore. Further, the side bed plate assembly 64 connected to the width-direction one-end side, that is, the base end side, of the rotating middle bed plate assembly 62 is bent upwardly to provide an upwardly convex surface so that the user is prevented from dropping out of the bed plate structure when he or she experiences any body change in the right or left direction.

In the case where the user lying on the bed plate structure 61 thus experience his or her body change, the middle bed plate assembly 62 has the other-end side driven in the raised direction with the width-direction one-end side as a fulcrum. For this reason, the width-direction one-end side, that is, the lower end side, of the rotating middle bed plate assembly 62 is not displaced to a height level substantially lower than any support height level of the bed plate structure 61 and the middle bed plate assembly 62 can be rotated in such a manner. Even if the support height of the bed plate structure 61 is made enough low, the user can experience his or her body position change by rotating the middle bed plate assembly 62 in the right/left direction.

In the case where the user experiences his or her body position change with the middle bed plate assembly 62 rotated in the right or in the left direction, if the support height of the bed plate structure is great, the bed occupant feels discomfort or ill at ease and it is better, therefore, to achieve the body position change in a low position.

If the support height of the bed plate structure is made enough low, the user, such as an ill or an elderly person in particular, can readily get into and out of the bed plate structure 61 without the help of any attendant or caretaker.

with the bed plate structure 61 is in a horizontal position, the paired engaging pins 52 on the support frame 25 engage with the associated steady grooves 50 at the retaining member 49 provided on the rotation frame 32 side so that the rotation frame 32 is prevented from being shaken in the right/left direction.

If the bed apparatus is used with the rotation frame assembly 32 in the horizontal state, then the bed user never will suffer any discomfort which would otherwise been involved due to the shaking of the bed frame structure 61 in the right/left direction. That is, even if the rotation frame 32 is so structured as to be rotated by the link mechanism 40A, the rotation frame 32 can be prevented from being shaken.

Further, the engaging pins 52 are automatically brought into and out of engagement with the associated steady grooves 50 through the operation of the link mechanism 40A. For this reason, no specific extra operation is necessary and the bed apparatus is easier in operation and very advantageous.

In order to achieve a "back"-raising operation of the bed plate structure 61, the raising/lowering motion drive mechanism 71 is operated with the bed plate structure 61 in the horizontal position. That is, the paired drive source 73 is operated to enable the first and second rotation shafts 74 and 75 to be rotated at which time the push-up arms 77 and 78 are moved in an interlocking manner.

with the first push-up arm 77 driven in the raised direction, the first bed plate 62*a* of the middle bed plate assembly 62 is raised as indicated by the phantom line in FIG. 1 and the first bed plates 64*a* of the paired side bed plate assemblies 64 are moved interlockingly so that the bed user can have his or her upper body half moved to a raised position. With the second push-up arms 78 driven in the raised direction, the third bed plate 62*c* of the middle bed plate assembly 62 is rotated with one end connected to the second bed plate 62*b* acting as a fulcrum, that is, rotated at the other end side in a raised direction so that the fourth bed plate 62*d* connected to the other-end side of the third bed plate is raised on its one-end side.

That is, the third bed plate 62*c* and fourth bed plate 62*d* are bent in an upwardly convex, substantially dogleg-like manner and the third and fourth bed plates 64*c* and 64*d* of the paired side bed plates 64 are moved in an interlocking manner. The user, having his or her upper body half raised, is held in an upwardly leg-bent position by the third bed plates 62*c* and 64*c* and fourth bed plates 62*d* and 64*d* so that he or she can be held in upper half body-raised position comfortably and at ease.

Further, since the rest frame 21, support frame 25 and bed plate structure 61 is detachable from the base 1, these component parts can readily be carried by the user's hand on transportation, etc.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A bed apparatus comprising:

a support frame;

a rotation frame having a one-end side and an other-end side supported on the support frame in a width direction, each of the one-end side and the other-end side serving as a fulcrum, and one of the one-end side and the other-end side being rotatable in a direction in which an opposite-end side of the rotation frame is raised;

rotation drive means for rotating the rotation frame, the rotation drive means having a link mechanism coupled to the rotation frame and a drive source provided on the support frame and adapted to drive the link mechanism; and a bed plate structure having a middle bed plate assembly and a pair of side bed plate assemblies, each of the pair of side bed plate assemblies being provided on a side of the middle bed plate assembly and being rotatable only in an upward direction, the bed plate structure being provided on the rotation frame such that when the rotation frame is rotated in a rotation direction the respective one of the pair of side bed plate assemblies which is situated on a lower side of the rotation direction is abutted against the support frame to allow the bed plate structure to be upwardly bent;

wherein the rotation frame includes retaining means for preventing the rotation frame from shaking in the rotation direction, the retaining means comprising:

retaining link devices coupled at both end portions to the link mechanism such that when the link mechanism is driven in a longitudinal direction the one of the one-end side and the other-end side of the rotation frame situated rearward of the longitudinal direction serves as a fulcrum and the other of the one-end side and the other-end side of the rotation frame is rotated in a raised direction;

a pair of retaining members having a retaining groove opened at one-end face side and at a lower-end face side and provided at longitudinal end portions with the one-end face sides of the respective grooves situated in an opposed relation; and a pair of engaging pins provided on the support frame, the engaging pins being engaged with the retaining grooves to prevent the rotation frame from being rotated in a width direction, and disengaging from the retaining grooves situated on a forward end side in a moving direction when the retaining link devices are moved by the link mechanism in the longitudinal direction.

2. The bed apparatus of claim 1, wherein the middle bed plate assembly and the pair of side bed plate assemblies of the bed plate structure are each divided into a plurality of rotatably coupled bed plates, at least one bed plate of the middle bed plate assembly being fixed to the rotation frame and the other bed plates being raisable or lowerable, and the rotation frame being equipped with a raising/lowering motion drive means for raising and lowering the other bed plates.

3. The bed apparatus of claim 2, wherein the raising/lowering motion drive means includes first push-up means for pushing up a bed plate on one longitudinal end side of the bed plate structure and second push-up means for pushing up a bed plate, in an upwardly convex manner, on the other longitudinal end side of the bed plate structure.

4. The bed apparatus of claim 1, wherein the bed plate structure is molded out of a synthetic resin.

5. The bed apparatus of claim 4, wherein the bed plate structure is blow-molded out of a synthetic resin to provide a hollow structure.

6. The bed apparatus of claim 4, wherein the bed plate structure includes air ports as through holes in a thickness direction.

7. The bed apparatus of claim 4, wherein the middle bed plate assembly and the pair of side bed plate assemblies of the bed plate structure are rotatably coupled together by thin-wall portions formed simultaneously as the bed plate structure is molded.

8. A bed apparatus comprising:

a support frame;

a rotation frame having a one-end side and an other-end side supported on the support frame in a width direction, each of the one-end side and the other-end side serving as a fulcrum, and one of the one-end side and the other-end side being rotatable in a direction in which an opposite-end side of the rotation frame is raised;

rotation drive means for rotating the rotation frame, the rotation drive means having a link mechanism coupled to the rotation frame and a drive source provided on the support frame and adapted to drive the link mechanism; and a bed plate structure having a middle bed plate assembly and a pair of side bed plate assemblies, each of the pair of side bed plate assemblies being provided on a side of the middle bed plate assembly and being rotatable only in an upward direction, the bed plate structure being provided on the rotation frame such that when the rotation frame is rotated in a rotation direction the respective one of the pair of side bed plate assemblies which is situated on a lower side of the rotation direction is abutted against the support frame to allow the bed plate structure to be upwardly bent;

wherein the rotation frame has a pair of rotatable support rollers spaced apart at a predetermined interval on longitudinal end portions, and the support frame has a corresponding pair of receivers having an open recess at an upper end face where the corresponding support rollers are supported in an engaging manner.

9. The bed apparatus of claim 8, wherein the middle bed plate assembly and the pair of side bed plate assemblies of the bed plate structure are each divided into a plurality of rotatably coupled bed plates, at least one bed plate of the middle bed plate assembly being fixed to the rotation frame and the other bed plates being raisable or lowerable, and the rotation frame being equipped with a raising/lowering motion drive means for raising and lowering the other bed plates.

10. The bed apparatus of claim 9, wherein the raising/lowering motion drive means includes first push-up means for pushing up a bed plate on one longitudinal end side of the bed plate structure and second push-up means for pushing up a bed plate, in an upwardly convex manner, on the other longitudinal end side of the bed plate structure.

11. The bed apparatus of claim 8, wherein the bed plate structure is molded out of a synthetic resin.

12. The bed apparatus of claim 11, wherein the bed plate structure is blow-molded out of a synthetic resin to provide a hollow structure.

13. The bed apparatus of claim 11, wherein the bed plate structure includes air ports as through holes in a thickness direction.

14. The bed apparatus of claim 11, wherein the middle bed plate assembly and the pair of side bed plate assemblies of the bed plate structure are rotatably coupled together by thin-wall portions formed simultaneously as the bed plate structure is molded.

15. A bed apparatus comprising:

a base;

a rest frame provided on the base;

a raising/lowering drive mechanism provided on the base and adapted to raise and lower the rest frame;

a support frame provided on the rest frame;

a rotation frame having a one-end side and an other-end side supported on the support frame in a width direction, each of the one-end side and the other-end side serving as a fulcrum, and one of the one-end side and the other-end side being rotatable in a direction in which an opposite-end side of the rotation frame is raised;

rotation drive means for rotating the rotation frame, the rotation drive means having a link mechanism coupled to the rotation frame and a drive source provided on the support frame and adapted to drive the link mechanism; and a bed plate structure having a middle bed plate assembly and a pair of side bed plate assemblies, each of the pair of side bed plate assemblies being provided on a side of the middle bed plate assembly and being rotatable only in an upward direction, the bed plate structure being provided on the rotation frame such that when the rotation frame is rotated in a rotation direction the respective one of the pair of side bed plate assemblies which is situated on a lower side of the rotation direction is abutted against the support frame to allow the bed plate structure to be upwardly bent;

wherein the raising/lowering drive mechanism includes a link mechanism for raising and lowering the rest frame in a horizontal state without sliding in a horizontal direction and a drive source for operating the link mechanism, the link mechanism comprising:

a rotation shaft rotatably provided on the base and rotated by the drive source;

a lever having one end pivoted on the rotation shaft and a roller provided at an other end thereof, the lever being movably engaged with a guide rail provided on the rest frame; and a connection link set to a length corresponding to one half of the lever and having one end pivoted at a longitudinal midpoint of the lever and an other end pivoted to the rest frame.

16. The bed apparatus of claim 15, wherein the bed plate structure is molded out of a synthetic resin.

17. The bed apparatus of claim 16, wherein the bed plate structure is blow-molded out of a synthetic resin to provide a hollow structure.

18. The bed apparatus of claim 16, wherein the bed plate structure includes air ports as through holes in a thickness direction.

19. The bed apparatus of claim 16, wherein the middle bed plate assembly and the pair of side bed plate assemblies of the bed plate structure are rotatably coupled together by thin-wall portions formed simultaneously as the bed plate structure is molded.

* * * * *